US006258180B1

(12) United States Patent
Wilde et al.

(10) Patent No.: US 6,258,180 B1
(45) Date of Patent: Jul. 10, 2001

(54) WEAR RESISTANT DUCTILE IRON

(75) Inventors: Al Wilde; Dan Korpi; Brian Schultz, all of Menominee, MI (US)

(73) Assignee: Waupaca Foundry, Inc., Waupaca, WI (US)

( * ) Notice: Subject to any disclaimer, the term of this patent is extended or adjusted under 35 U.S.C. 154(b) by 0 days.

(21) Appl. No.: 09/322,611

(22) Filed: May 28, 1999

(51) Int. Cl.[7] ..... C21D 5/00

(52) U.S. Cl. ..... 148/321; 148/545; 148/612; 148/663; 420/13

(58) Field of Search ..... 148/321, 545, 148/612, 663; 420/13

(56) References Cited

U.S. PATENT DOCUMENTS

| | | | | |
|---|---|---|---|---|
| 2,885,284 | * | 5/1959 | Moore | 75/124 |
| 3,893,873 | * | 7/1975 | Hanai et al. | 148/12 R |
| 4,028,099 | | 6/1977 | Cole et al. | 75/130 B |
| 4,033,766 | | 7/1977 | Cole et al. | 75/123 CB |
| 4,054,275 | | 10/1977 | Cole et al. | 266/93 |
| 4,164,148 | | 8/1979 | Laforet | 73/432 R |
| 4,312,668 | | 1/1982 | Mannion et al. | 75/130 R |
| 4,313,758 | | 2/1982 | Henning et al. | 75/130 R |
| 4,452,647 | | 6/1984 | Sailas | 148/3 |
| 4,464,198 | | 8/1984 | Mannion et al. | 75/130 R |
| 4,511,401 | | 4/1985 | Mannion et al. | 75/130 R |
| 4,635,701 | | 1/1987 | Sare et al. | 164/102 |
| 4,666,533 | | 5/1987 | Kovacs et al. | 148/2 |
| 4,737,199 | | 4/1988 | Kovacs | 148/3 |
| 4,838,956 | * | 6/1989 | Satou et al. | 148/3 |
| 4,867,804 | * | 9/1989 | Kobayashi | 148/3 |
| 4,877,435 | | 10/1989 | Haeberle, Jr. et al. | 65/1 |
| 4,880,477 | | 11/1989 | Hayes et al. | 148/141 |
| 4,913,878 | | 4/1990 | Dawson et al. | 420/18 |
| 4,953,612 | | 9/1990 | Sare et al. | 164/102 |
| 5,043,028 | | 8/1991 | Kovacs et al. | 148/321 |
| 5,122,204 | | 6/1992 | McDonald | 148/323 |
| 5,139,579 | | 8/1992 | Kovacs et al. | 148/545 |
| 5,246,510 | | 9/1993 | Kovacs et al. | 148/612 |
| 5,569,395 | | 10/1996 | Arnoldy | 219/76.14 |
| 5,611,143 | | 3/1997 | Graf | 29/895.3 |
| 5,837,069 | | 11/1998 | Deards et al. | 148/323 |

FOREIGN PATENT DOCUMENTS

60110843 * 11/1983 (JP) .

* cited by examiner

*Primary Examiner*—Roy King
*Assistant Examiner*—Nicole Coy
(74) *Attorney, Agent, or Firm*—Harness, Dickey & Pierce, P.L.C.

(57) ABSTRACT

Austempered ductile iron castings having primary iron carbides uniformly dispersed throughout an ausferritic matrix, and methods of making the same, are described. The dissolution of the primary iron carbides into the ausferritic matrix during the austempering process is prevented or lessened by altering the chemical composition of the ductile iron, employing a stabilizing agent, by altering the processing parameters of the austempering process, or any combination thereof.

35 Claims, 6 Drawing Sheets

WEAR RESISTANT DUCTILE IRON

BACKGROUND OF THE INVENTION

1. Technical Field

The present invention relates generally to iron castings and methods for preparing same, and particularly to ductile iron castings comprised of primary carbides dispersed in an ausferritic matrix and methods for preparing the same.

2. Discussion

The advent of highly complex and very expensive mechanized equipment to perform agricultural functions, such as harvesting, has encouraged manufacturers to develop and provide component parts that can withstand the rigors associated with regular use under harsh operating conditions. For example, the tines on a combine-harvester are subjected to a series of stresses, strains, impacts, and abrasions during the course of a normal operational cycle. Therefore, the materials comprising the tines must be able to achieve the desired level of performance characteristics, such as wear resistance and impact strength, in order to satisfy consumer expectations, reduce component repairs and resulting equipment downtime, and reduce the number of warranty claims.

Generally, these tines are comprised of metallic materials such as iron, to which relatively small amounts of other metallic and/or non-metallic materials have been added, in order to enhance the aforementioned mechanical properties. One particular type of iron that has been used is ductile iron.

Ductile iron, also known as nodular iron or spheroidal iron because of the shape of the graphite particles, is noted primarily for its high strength and toughness. Though made from the same basic materials as gray iron (i.e., 2–4 weight % carbon, 1–3 weight % silicon, with the remainder being iron), a small amount of magnesium, or magnesium and trace amounts of cerium, is inoculated during casting to control the shape and distribution of the graphite. Tensile properties range from 50,000 to 120,000 lb/in$^2$ (345 to 827 MPa) ultimate strength, 25,000 to 90,000 lb/in$^2$ (172 to 621 MPa) yield strength, and 2 to 20% elongation. Most ductile iron castings are used as cast, but subsequent heat treatment can be beneficial. Annealing, which provides a ferritic structure (i.e., almost pure iron), maximizes toughness at the expense of strength. Normalizing, often followed by tempering, induces a pearlitic structure (i.e., a lamellar aggregate of ferrite (almost pure iron) and cementite ($Fe_3C$)), providing intermediate strength and toughness. A martensitic structure (i.e., an interstitial, super saturated solid solution of carbon in iron having a body-centered tetragonal lattice), induced by quenching, usually in oil, provides the highest strength and hardness, but the least toughness. The modulus of elasticity of ductile iron, 22×106 to 25×106 lb/in$^2$ (152,000 to 172,000 MPa), is typically greater than that of gray iron, as is its high-temperature oxidation resistance, but its machinability is about the same. Ductile iron castings are widely used in the automotive industry for crankshafts, camshafts, steering knuckles, pinions, gears, and many other components. They are also used for a variety of machinery applications, marine applications, and equipment used in the paper and glass industries.

In the production of ductile iron, it is typically common practice to add a material generally referred to as an inoculant to the ductile iron in order to prevent the formation of primary iron carbides within the casting. Primary iron carbides are very hard, and thus have excellent wear resistance. However, the effects of primary iron carbides in ductile iron castings are normally quite detrimental as they reduce the machinability, ductility and impact properties. The inoculant is typically a granular ferrosilicon material (e.g., 75 weight % silicon and 25 weight % iron). While the ductile iron is still in the liquid state, the inoculant is added in order to provide sites for the carbon to attach to and begin to solidify as pure carbon (i.e., graphite). When there is not sufficient inoculant nuclei in the ductile iron, the carbon does not have a site to begin to grow and solidifies as an iron-carbon compound called cementite ($Fe_3C$), or iron carbide.

Although ductile iron was an improvement over previous materials, it lacked the requisite wear resistance and impact properties that were needed by manufacturers. Other approaches to solve this problem were tried, such as the use of silicon carbide impregnated with aluminum, forgings, die cast materials containing wear resistant coatings, as well as different grades of iron. However, none of these approaches produced a satisfactory solution.

One recent approach has been the use of austempered ductile iron (hereinafter referred to as "ADI"). ADI, an alloyed ductile iron having a structure of ferrite and carbon-rich austenite, has been known for many years but seldomly used because of the difficulty required to induce this structure by heat treatment. Because of the exceptional strength and toughness possible with careful control of heat treatment, however, it has recently emerged as a promising material, especially for automotive and truck applications. The alloying elements are nickel, copper, or molybdenum, or combinations of these, and their purpose is to increase hardenability. The elements delay pearlite formation, permitting the casting to be cooled from austenitizing temperatures to the austempering transformation range without forming pearlite or other high-temperature transformation products during quenching.

Heat treatment involves (1) heating to austenitizing temperature (i.e., generally 1550 to 1700° F. (801 to 912° C.) depending upon the iron chemistry) and holding at this temperature until the structure has transformed to face-centered-cubic austenite and this austenite is saturated with carbon; (2) quenching to a temperature above the martensite start temperature (i.e., 450 to 750° F. (232 to 399° C.) depending upon the iron chemistry) usually in molten salt or a medium capable of providing a quenching rate sufficient to avoid pearlite formation; (3) holding at this temperature for sufficient time austenite (e.g., 30 minutes to 5 hours, depending upon the required properties) to transform the austenite to a structure of acicular ferrite and carbon-rich austenite (i.e., austempering); and (4) cooling to room temperature. No subsequent tempering is necessary. The resulting acicular ferrite and carbon-rich austenite composition is commonly referred to as "ausferrite" connoting its two primary constituents (i.e., austenite and ferrite).

The bainitic reaction temperature, commonly called the austempering temperature, determines mechanical properties. High austempering temperatures promote ductility, fatigue strength, and impact strength, but reduce hardness. Low austempering temperatures increase strength and hardness. Tensile yield strength can range from 80,000 to 180,000 lb/in$^2$ (552 to 1,240 MPa), with corresponding ultimate strengths of 125,000 to 230,000 lb/in$^2$ (860 to 1,585 MPa), elongations of up to 10%, and hardness from the range of Brinell 269 to 321 to Brinell 444 to 555. Impact strength is about 75 ft•lb (102 J) for 80,000 lb/in$^2$ (552 MPa) yield strength material, and 30 ft•lb (41 J) for the 140,000 lb/in$^2$ (965 MPa) material.

Although ADI represented a significant step toward finding a satisfactory solution for this problem, the abrasion characteristics (e.g., wear resistance) of the tines produced with ADI were not completely satisfactory.

Recently, the use of primary iron carbides in conjunction with ADI has been suggested as a way to produce ductile or gray iron chill castings with improved wear resistance properties. As previously noted, primary iron carbides are unwanted by-products which are formed during the production of ductile iron. Although the austempering process normally dissolves all or most of the primary iron carbides, it has been suggested that by altering the heating and cooling parameters, it is possible to produce a surface layer on the casting which is rich in primary iron carbides.

U.S. Pat. No. 5,837,069 to Deards et al., which is expressly incorporated herein by reference, discloses that a primary iron carbide layer can be formed on the surface of either a gray iron or an ADI cast component, such as a camshaft, which is subjected to rolling contact stress or to sliding stress. According to Deards et al., the component is first cast in a conventional chill casting process to give an iron casting which has a pearlitic and/or ferritic structure with its surface portions rich in primary iron carbides (approximately 60% by volume). Next, the casting is heated to and maintained at a temperature (i.e., 801° C.) sufficient to ensure that all of the pearlitic and/or ferritic structure was converted to an austenitic structure but not so long that the primary iron carbides were dissolved. Next, the casting is cooled (i.e., from 801° C. to 380° C.) rapidly enough to prevent the austenite from converting back into pearlite and/or ferrite. Finally, the casting is maintained at 380° C. long enough to ensure that substantially all of the austenite was converted to ausferrite.

The Deards et al. process is deficient in that it requires numerous, time-consuming temperature and processing control steps in order to avoid loss of the primary iron carbides. Further, the Deards et al. process only produces a surface layer of primary iron carbides. Although this may be appropriate for components that endure little or no impact stresses (e.g., camshafts), it is not appropriate for components that endure repeated high impact stresses (e.g., tines). Additionally, many iron castings do not employ a chill casting process;

thus, the Deards et al. process would not be appropriate.

Other examples of processes and articles relating to casting technology include U.S. Pat. Nos. 4,028,099 to Cole et al.; U.S. Pat. No. 4,033,766 to Cole et al.; U.S. Pat. No. 4,054,275 to Cole et al.; U.S. Pat. No. 4,164,148 to Laforet; U.S. Pat. No. 4,312,668 to Mannion et al.; U.S. Pat. No. 4,313,758 to Henning et al.; U.S. Pat. No. 4,452,647 to Sailas; U.S. Pat. No. 4,464,198 to Mannion et al.; U.S. Pat. No. 4,511,401 to Mannion et al.; U.S. Pat. No. 4,635,701 to Sare et al.; U.S. Pat. No. 4,666,533 to Kovacs et al.; U.S. Pat. No. 4,737,199 to Kovacs; U.S. Pat. No. 4,877,435 to Haeberle, Jr. et al.; U.S. Pat. No. 4,880,477 to Hayes, et al.; U.S. Pat. No. 4,913,878 to Dawson et al.; U.S. Pat. No. 4,953,612 to Sare et al.; U.S. Pat. No. 5,043,028 to Kovacs et al.; U.S. Pat. No. 5,122,204 to McDonald; U.S. Pat. No. 5,139,579 to Kovacs et al.; 5,246,510 to Kovacs, et al.; U.S. Pat. No. 5,569,395 to Arnoldy; and U.S. Pat. No. 5,611,143 to Graf, all of which are expressly incorporated herein by reference.

Therefore, there exists a need for ductile iron castings comprised of primary iron carbides uniformly dispersed throughout an ausferritic matrix and methods for preparing the same.

SUMMARY OF THE INVENTION

In accordance with one embodiment of the present invention, a cast iron component that has undergone an austempering process is comprised of primary iron carbides uniformly dispersed throughout a substantially ausferritic matrix.

In accordance with another embodiment of the present invention, a cast ductile iron component that has undergone an austempering process is comprised of primary iron carbides uniformly dispersed throughout a substantially ausferritic matrix, wherein a primary iron carbide stabilizing agent is added prior to the austempering process, wherein the stabilizing agent prevents or lessens the dissolution of the primary iron carbides into the ausferritic matrix during the austempering process.

In accordance with still another embodiment of the present invention, a method of forming a cast iron component comprises: providing an amount of iron characterized by having either a ferritic, pearlitic, or a combined ferritic and pearlitic matrix with primary iron carbides uniformly dispersed therein; and austempering the iron to produce a substantially ausferritic matrix with the primary iron carbides uniformly dispersed therein.

In accordance with yet another embodiment of the present invention, a method of forming a cast iron component comprises: providing an amount of iron characterized by having either a ferritic, pearlitic, or a combined ferritic and pearlitic matrix with primary iron carbides uniformly dispersed therein; providing an amount of primary iron carbide stabilizing agent; adding the stabilizing agent to the iron; and austempering the iron to produce a substantially ausferritic matrix with the primary iron carbides uniformly dispersed therein, wherein the stabilizing agent is added in a sufficient amount so as to prevent or lessen the dissolution of the primary iron carbides into the ausferritic matrix during the austempering process.

A more complete appreciation of the present invention and its scope can be obtained from understanding the accompanying drawings, which are briefly summarized below, the following detailed description of the invention, and the appended claims.

BRIEF DESCRIPTION OF THE DRAWINGS

The same reference numerals refer to the same parts throughout the various Figures.

DETAILED DESCRIPTION OF THE INVENTION

The weight percentages expressed are based upon the total weight of the iron matrix, whether it be ferritic, pearlitic, ferritic/pearlitic, or ausferritic, unless indicated otherwise. The volume percentages expressed are based upon the total volume of the iron matrix, whether it be ferritic, pearlitic, ferritic/pearlitic, or ausferritic, unless indicated otherwise.

Figure 1:
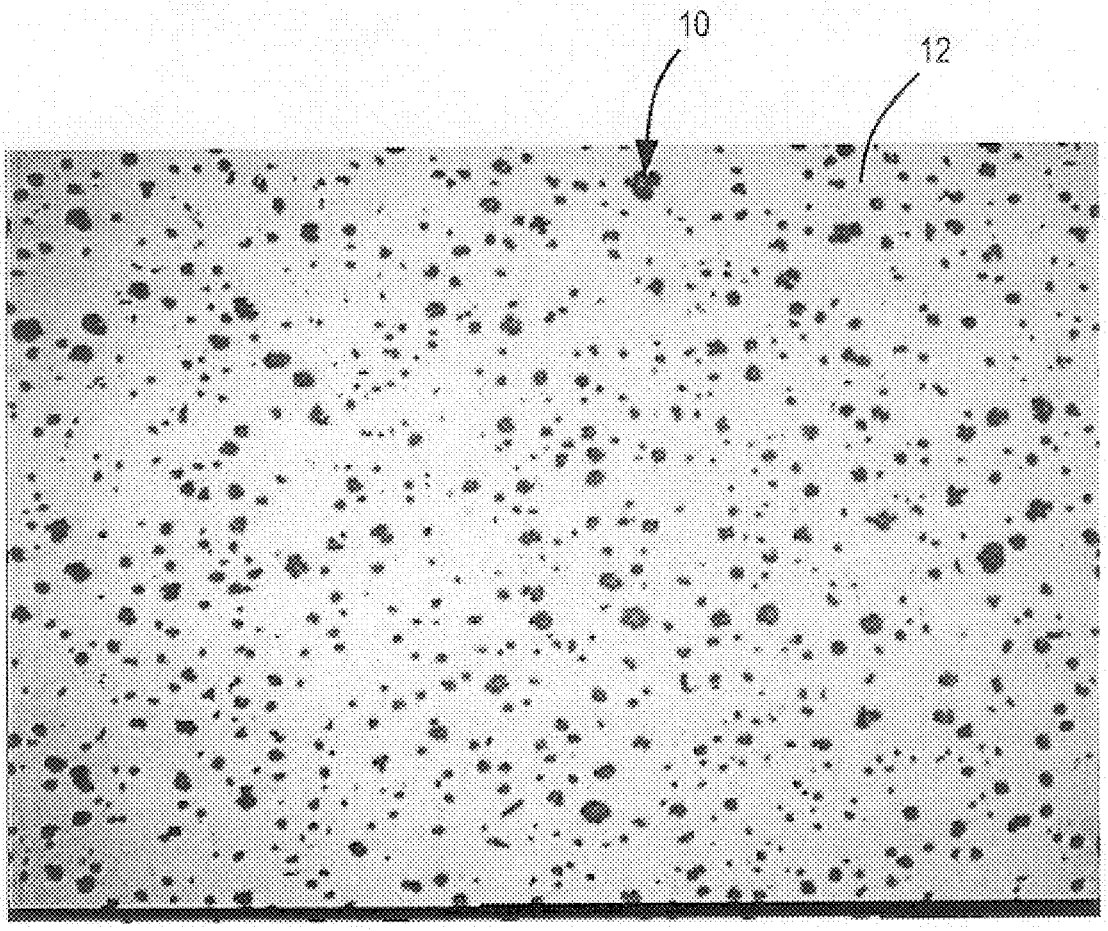
FIGURE 1 (PRIOR ART)
FIG. 1 is a photomicrograph (100×magnification) of a cross-sectional view of a ductile iron sample, in accordance with the prior art.

Referring to FIG. 1, there is shown a 100×magnification photomicrograph of a polished and unetched sample of a ductile iron casting, in accordance with the prior art. The dark "specks" are graphite nodules 10, whereas the lighter background is the iron matrix 12 (i.e., ferrite, pearlite, or a combination of the two). The modularity of this sample is 95%. The term "nodularity" is expressed as a percentage of the total graphite pieces that are nodular or spherical in shape.

Figure 2:
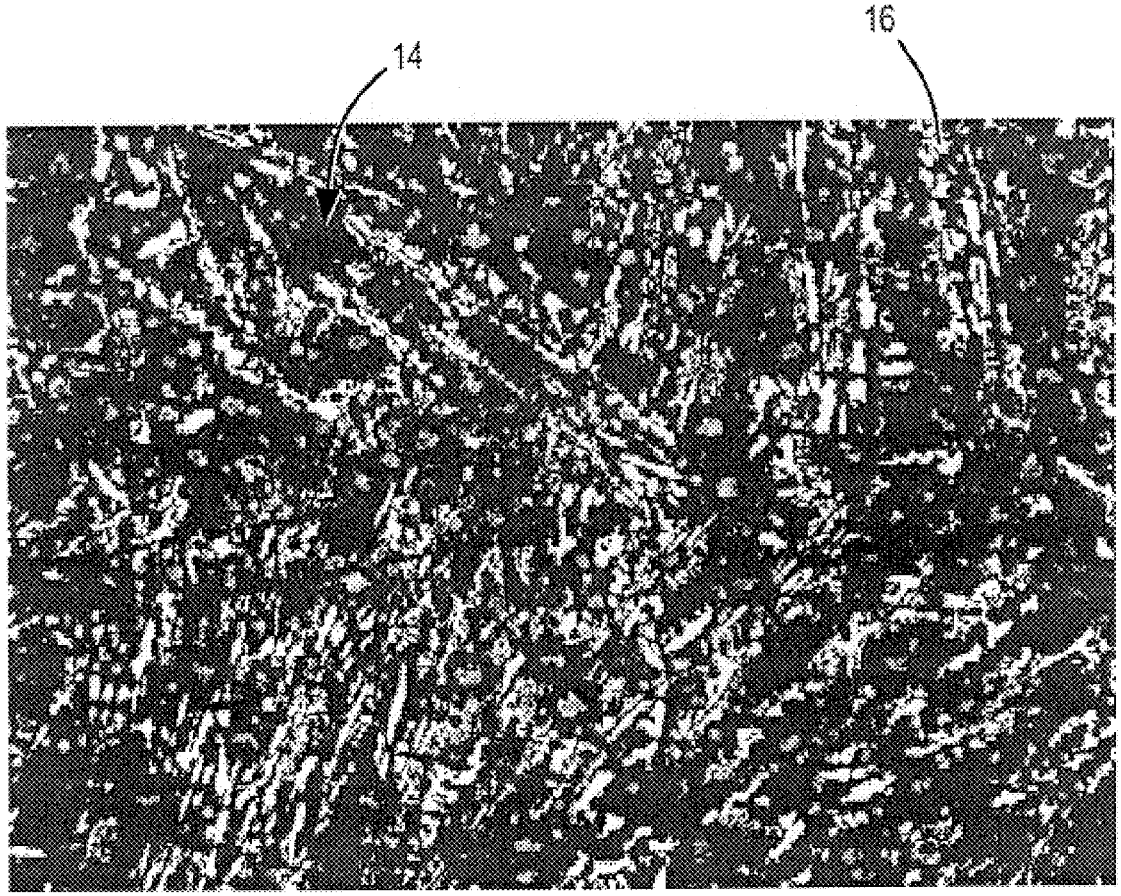
FIGURE - 2 (PRIOR ART)
FIG. 2 is a photomicrograph (100×magnification) of the cross-sectional view of the ductile iron sample shown in FIG. 1 after being etched with an acid solution, in accordance with the prior art.

Referring to FIG. 2, there is shown the same sample of FIG. 1; however, the sample has been treated or "etched" with a 2 volume % Nital acid solution in order to draw out the ferrite/pearlite/carbidic structures of the sample. In this view, the matrix consists of 50 volume % primary iron carbides 14 (the light colored phase), 50 volume % pearlite 16 (the dark colored phase), and 0 volume % ferrite.

The present invention discloses austempered ductile iron castings that are comprised of primary iron carbides uniformly dispersed throughout an ausferritic matrix, and methods of producing the same. As previously noted, a conventional austempering process typically dissolves all or most of the primary iron carbides into the ausferritic matrix. Therefore, it was necessary to develop a method for preventing or lessening the dissolution of the primary iron carbides into the ausferritic matrix during the austempering process. In accordance with one embodiment of the present invention, the chemical composition of the initial iron sample is altered in order to promote primary iron carbide formation as well as to stabilize the primary iron carbides so as to prevent or lessen the amount of primary iron carbides that are dissolved during the process. In accordance with another embodiment of the present invention, a primary iron carbide promotor or a primary iron carbide stabilizing agent, such as, but not limited to, molybdenum, may be added to the initial iron sample in order to promote primary iron carbide formation as well as to prevent or lessen the amount of primary iron carbides that are dissolved during the austempering process. In accordance with still another embodiment of the present invention, the processing parameters of the austempering process are altered so as to prevent or lessen the amount of primary iron carbides that are dissolved during the process. In accordance with still another embodiment of the present invention, any or all of the three aforementioned methods are combined so as to prevent or lessen the amount of primary iron carbides that are dissolved during the austempering process.

In accordance with one embodiment of the present invention, little or no inoculant is added to the iron at any time during the initial casting process (i.e., prior to the initiation of the austempering process). If inoculant is added, the amounts added and the timing of the additions are altered from conventional inoculation practices. As previously noted, conventional amounts of inoculant typically prevent the formation of primary iron carbides, which is the opposite effect that the present invention is attempting to achieve.

In conventional ductile iron production, the inoculant is typically added in two stages. First, a granular ferrosilicon inoculant (e.g., 0.1 weight %) is added as the liquid iron is poured from a transfer ladle into the receiver of the autopour holding furnace. Second, a very fine dust of a ferrosilicon inoculant (e.g., 0.1 weight %) is then added to the liquid iron as it leaves the autopour and enters the mold.

In accordance with one embodiment of the present invention, the second inoculation step has been completely eliminated with the first inoculation comprising 0.2 weight % of a ferrosilicon inoculant. Without being bound to a particular theory of the operation of the present invention, it is believed that eliminating the second inoculation step aids in the promotion of primary iron carbides in the liquid iron, while the first inoculation step aids in increasing impact resistance in the final iron casting.

In any event, if inoculant is added, it is preferably added to the iron casting when the iron is still in the liquid phase, i.e. prior to any significant hardening.

With respect to altering the chemical composition of the ductile iron, it is preferred to have a relatively low silicon content and a relatively high manganese content, as compared to conventional ductile iron, for reasons which will be explained herein. For example, conventional ductile iron typically has 2.4 to 3.0 weight % silicon, whereas in accordance with a preferred embodiment of the present invention, a ductile iron is employed having a silicon content of less than about 2.4 weight %. Further, conventional ductile iron typically has 0.2 to 0.3 weight % manganese, whereas in accordance with a preferred embodiment of the present invention, a ductile iron is employed having a manganese content of about 0.5 to about 0.6 weight %.

Additionally, a primary iron carbide promoter or stabilizing agent may be added to the iron before the austempering process. By "stabilizing agent" as that term is used herein, it is meant any material that either promotes primary iron carbide formation and/or prevents or lessens the amount of primary iron carbide dissolution during an austempering or any other heat treatment process. Although manganese is a slight primary iron carbide promoter, it is preferred to add molybdenum to the iron during the initial casting process, and in any event before the austempering process) in order to promote the formation of primary iron carbides in the initial ferritic and/or pearlitic matrix, as well as to prevent and/or lessen the dissolution of the primary iron carbides during the formation of the ausferritic matrix. In accordance with a preferred embodiment of the present invention, molybdenum in the amount of about 0.35 to about 0.5 weight % is added to the iron during the initial casting process. By comparison, conventional ductile iron typically has no molybdenum, or only trace amounts. It is envisioned that other materials may be used as stabilizing agents, such as, but not limited to, chromium.

Additionally, it is preferred to keep the copper and tin contents of the ductile iron as low as possible (e.g., no more than about 0.4 weight % for copper and no more than about 0.1 weight % for tin), as the copper and tin can affect austenitizing times. Other than the aforementioned chemical composition alterations and additions, the chemical composition of the ductile iron employed in the present invention is similar to conventional ductile iron.

With respect to the austempering process, normal temperature and time ranges may be employed, provided that the iron casting has either had its chemical composition altered as described above, had a primary iron carbide promotor or stabilizing agent added as described above, or a combination of the two. Without being bound to a particular theory of the operation of the present invention, it is believed that a lower than conventional austenitizing temperature range may be employed, or alternatively, a shorter than conventional austenitizing time period may be employed, if the iron contains relatively low (e.g., about less than 2.4) and/or relatively high (e.g., about 0.5) manganese weight percentages, as well as the afore-mentioned relatively low weight percentages of copper and tin.

Figure 3:
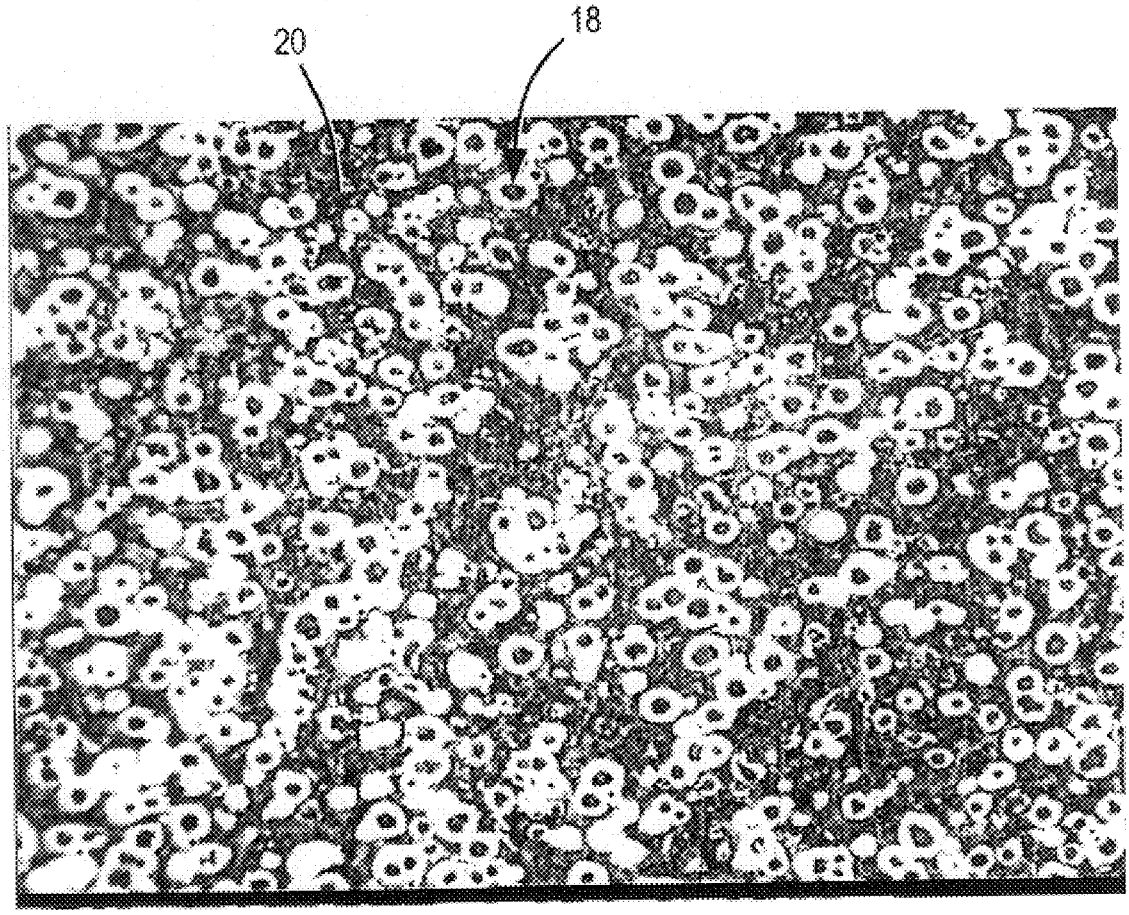
FIG. 3 is a photomicrograph (100×magnification) of a cross-sectional view of an austempered ductile iron sample, in accordance with one aspect of the present invention.

Referring to FIG. 3, there is shown a 100×magnification photomicrograph of a polished and unetched sample of an austempered ductile iron casting, produced in accordance with one aspect of the present invention. The initial ductile iron casting (i.e., pre-austemper) preferably has a primary iron carbide volume % of about 40 to about 70. This is accomplished by either using little or no inoculant, employing a primary iron carbide promotor or stabilizing agent, altering the chemical composition of the individual constituents of the ductile iron, or by any combination of the three. Preferably, the primary iron carbides are uniformly, or at least substantially uniformly dispersed throughout the initial ductile iron casting.

The composition of this sample was: 3.61 weight % carbon, 2.41 weight % silicon, 0.52 weight % manganese, 0.026 weight % phosphorous, 0.002 weight % sulfur, 0.035 weight % chromium, 0.175 weight % nickel, 0.486 weight % molybdenum, 0.40 weight % copper, 0.006 weight % tin, 0.017 weight % vanadium, with the rest being iron. Again, the dark specks are graphite nodules 18;whereas, the lighter background is the iron matrix 20. However, in this case, the iron matrix is comprised totally or substantially of ausferrite, as opposed to ferrite, pearlite, or a combination of the two. This is a result of the austempering process that converts all or substantially all of the ferrite and/or pearlite (as the case may be depending on the starting composition of the iron) to ausferrite. The nodularity of this sample is 80%.

Figure 4:
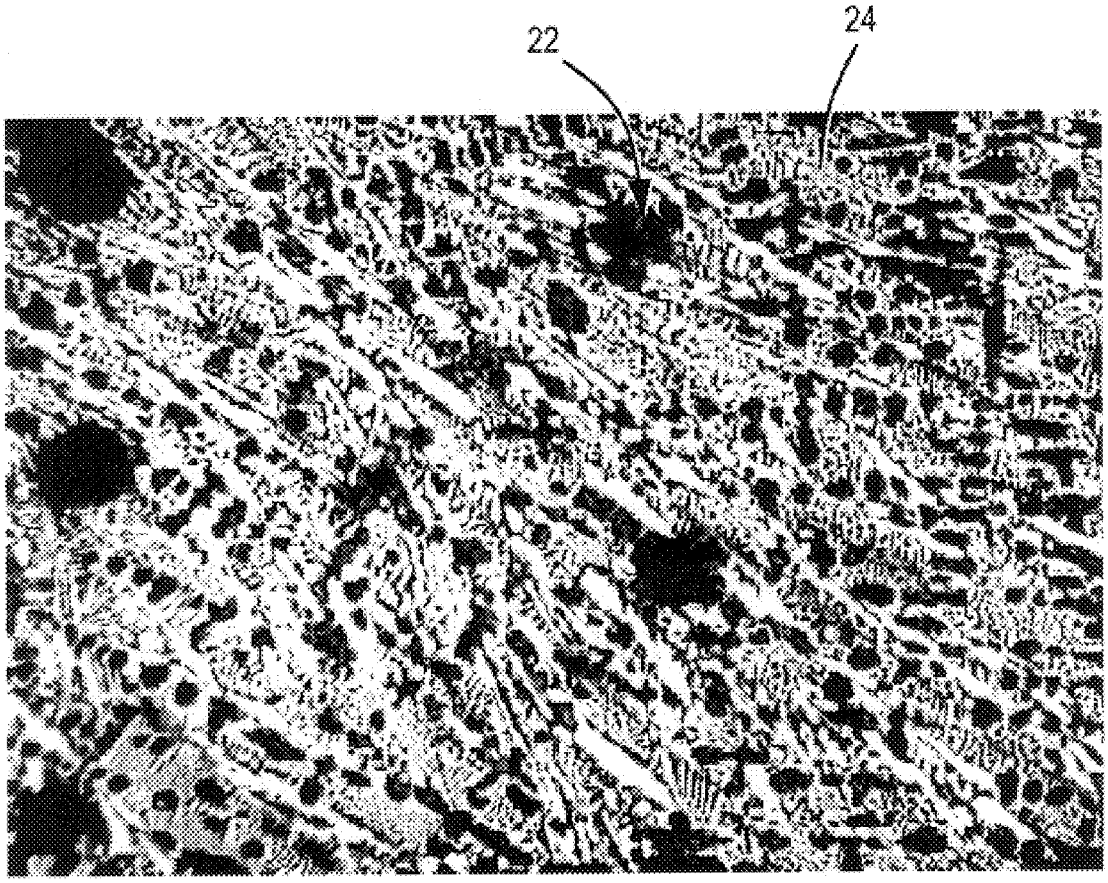
FIG. 4 is a photomicrograph (100×magnification) of the cross-sectional view of the austempered ductile iron sample shown in FIG. 3 after being etched with an acid solution, in accordance with one aspect of the present invention.

Referring to FIG. 4, there is shown the same sample of FIG. 3; however, the sample has been etched with a 2% Nital acid solution in order to draw out the carbidic/ausferritic structures of the sample. In this view, the matrix consists of 30 volume % primary iron carbides 22 (the light colored phase) and 70 volume % ausferrite 24 (the dark colored phase). Note how there is no ferrite and/or pearlite present in the iron casting sample that has been produced in accordance with the present invention.

Figure 5:
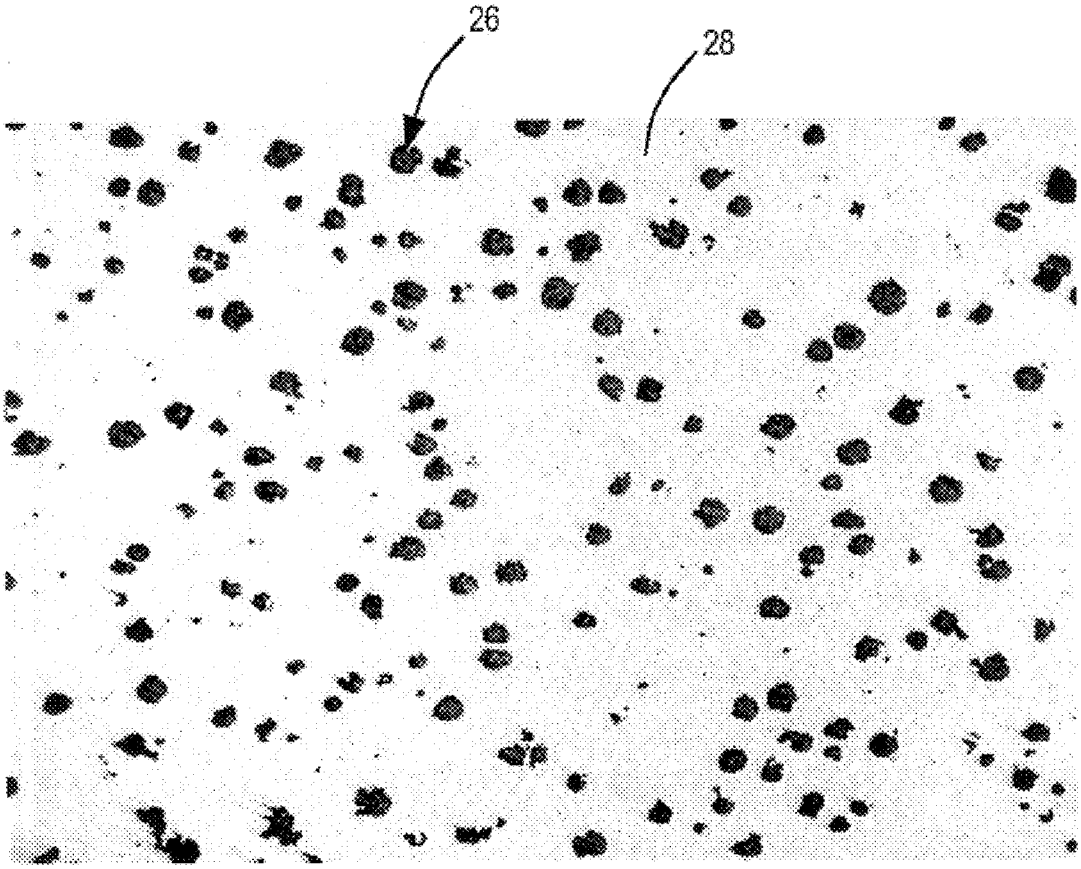
FIG. 5 is a photomicrograph (100×magnification) of a cross-sectional view of an austempered ductile iron sample having a different chemical composition than the sample depicted in FIGS. 3 and 4, in accordance with one aspect of the present invention.

Referring to FIG. 5, there is shown a 100×magnification photomicrograph of another polished and unetched sample of an austempered ductile iron casting, produced in accordance with one aspect of the present invention. Again, the initial ductile iron casting (i.e., pre-austemper) should have a primary iron carbide volume % of about 40 to about 70. Preferably, the primary iron carbides are uniformly, or at least substantially uniformly dispersed throughout the initial ductile iron casting.

The composition of this sample was: 3.56 weight % carbon, 2.41 weight % silicon, 0.52 weight % manganese, 0.027 weight % phosphorous, 0.003 weight % sulfur, 0.035 weight % chromium, 0.203 weight % nickel, 0.483 weight % molybdenum, 0.40 weight % copper, 0.006 weight % tin, 0.017 weight % vanadium, with the rest being iron. In this case, the sample has a slightly different chemical composition than the sample depicted in FIGS. 3 and 4. Again, the dark specks are graphite nodules 26; whereas, the lighter background is the iron matrix 28. Again, the iron matrix is comprised totally or substantially of ausferrite, as opposed to ferrite, pearlite, or a combination of the two. The nodularity of this sample is 95%.

Figure 6:
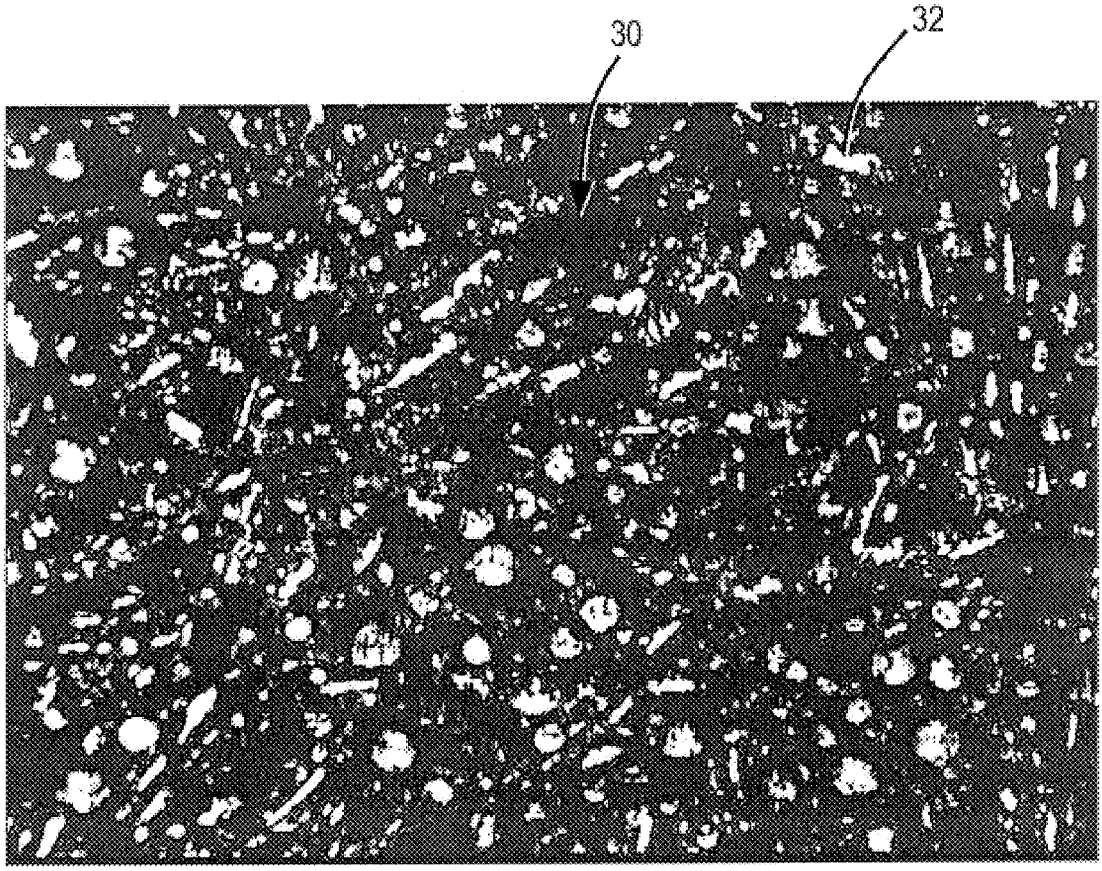
FIG. 6 is a photomicrograph (100×magnification) of the cross-sectional view of the austempered ductile iron sample shown in FIG. 5 after being etched with an acid solution, in accordance with one aspect of the present invention.

Referring to FIG. 6, there is shown the same sample of FIG. 5; however, the sample has been etched with a 2% Nital acid solution in order to draw out the carbidic/ausferritic structures of the sample. In this view, the matrix consists of 10 volume % primary iron carbides 30 (the light colored phase) and 90 volume % ausferrite 32 (the dark colored phase). Again, note how there is no ferrite and/or pearlite present in the iron casting sample that has been produced in accordance with the present invention.

After the austempering process is complete, the austempered ductile iron castings should have primary iron carbides uniformly, or at least substantially uniformly dispersed through an ausferritic, or at least a substantially ausferritic matrix, wherein the primary iron carbides are present in an amount in the range of about 10 to about 50 volume %, and preferably in the range of about 20 to about 40 volume %. It should be noted that the primary iron carbide volume % may be varied depending upon the particular application. Additionally, the austempered ductile iron castings should have a nodularity of about 70% or more, and preferably in the range of about 70 to about 95%. However, nodularity is subordinate to the attainment of the desired mechanical properties in the finished product, especially with respect to wear resistance.

By way of a non-limiting example, the following samples were analyzed for their pre- and post-tempering component volume percentages:

| | Pre-Austemper (Initial Casting) | | | Post-Austemper | |
|---|---|---|---|---|---|
| Sample | Carbides | Pearlite | Ferrite | Carbides | Ausferrite |
| A | 65 vol. % | 30 vol. % | 5 vol. % | 30 vol. % | 70 vol. % |
| B | 50 vol. % | 50 vol. % | 0 vol. % | 35 vol. % | 65 vol. % |
| C | 45 vol. % | 55 vol. % | 0 vol. % | 35 vol. % | 65 vol. % |

As the Example illustrates, the present invention preserves a significant volume percentage of primary iron carbides in the ausferritic matrix even after the initial iron casting has been subjected to an austempering process.

The austempered ductile iron castings of the present invention have a combination of relatively high impact strength (e.g., 5 to 10 ft•lb as determined by the Charpy impact test) and excellent wear resistance (e.g., no more than 10–20 $mm^3$ of material loss by a 2 inch long, 10 mm wide by 10 mm high sample mounted on a wheel running at 200 revolutions per minute for 1000 revolutions and exposed to a sand batch flowing at 293 grams per minute), making them particularly suitable for the production of tools, components, and implements, especially for the agricultural machinery industry.

The foregoing description is considered illustrative only of the principles of the invention. Furthermore, because numerous modifications and changes will readily occur to those skilled in the art, it is not desired to limit the invention to the exact construction and process shown as described above. Accordingly, all suitable modifications and equivalents that may be resorted to that fall within the scope of the invention as defined by the claims that follow.

What is claimed is:

1. A cast iron component that has undergone an austempering process, comprised of primary iron carbides uniformly dispersed throughout a substantially ausferritic matrix.

2. The component of claim 1, further comprising a primary iron carbide stabilizing agent, wherein the stabilizing agent prevents or lessens the dissolution of the primary iron carbides into the ausferritic matrix during the austempering process.

3. The component of claim 2, wherein the stabilizing agent is added prior to the austempering process.

4. The component of claim 2, wherein the stabilizing agent is comprised of molybdenum.

5. The component of claim 4, wherein the molybdenum comprises about 0.3 to about 0.5 weight percent of the ausferritic matrix.

6. The component of claim 1, wherein the ausferritic matrix comprises less than about 2.4 weight percent silicon.

7. The component of claim 1, wherein the ausferritic matrix comprises about 0.5 to about 0.6 weight percent manganese.

8. The component of claim 1, wherein the iron is comprised substantially of ductile iron.

9. The component of claim 1, wherein the primary iron carbides comprise at least about 10 volume percent of the ausferritic matrix.

10. The component of claim 1, wherein the primary iron carbides comprise at least about 20 volume percent of the ausferritic matrix.

11. The component of claim 1, wherein the primary iron carbides comprise up to about 50 volume percent of the ausferritic matrix.

12. The component of claim 1, wherein the primary iron carbides comprise about 10 to about 50 volume percent of the ausferritic matrix.

13. The component of claim 1, wherein the primary iron carbides comprise about 20 to about 50 volume percent of the ausferritic matrix.

14. The component of claim 1, wherein the ausferritic matrix has a nodularity of at least 95%.

15. The component of claim 1, wherein the ausferritic matrix has a nodularity of at least 80%.

16. The component of claim 1, wherein the ausferritic matrix has a nodularity of at least 70%.

17. The component of claim 1, wherein the ausferritic matrix has a nodularity in the range of about 70 to about 95%.

18. The component of claim 1, wherein the ausferritic matrix has a nodularity in the range of about 80 to about 95%.

19. The component of claim 1, wherein the ausferritic matrix has a nodularity in the range of about 70 to about 80%.

20. A cast ductile iron component that has undergone an austempering process, comprised of primary iron carbides uniformly dispersed throughout a substantially ausferritic matrix, wherein a primary iron carbide stabilizing agent is added prior to the austempering process, wherein the stabilizing agent prevents or lessens the dissolution of the primary iron carbides into the ausferritic matrix during the austempering process.

21. The component of claim 20, wherein the primary iron carbides comprise about 10 to about 50 volume percent of the ausferritic matrix.

22. The component of claim 20, wherein the ausferritic matrix has a nodularity in the range of about 70 to about 95%.

23. A method of forming a cast iron component, comprising:

providing an amount of iron characterized by having either a ferritic, pearlitic, or a combined ferritic and pearlitic matrix with primary iron carbides uniformly dispersed therein; and austempering the iron to produce a substantially ausferritic matrix with the primary iron carbides uniformly dispersed therein.

24. The method of claim 23, further comprising:

providing an amount of primary iron carbide stabilizing agent; and adding the stabilizing agent to the iron, wherein the stabilizing agent is added in a sufficient amount so as to prevent or lessen the dissolution of the primary iron carbides into the ausferritic matrix during the austempering process.

25. The method of claim 24, wherein the stabilizing agent is added prior to the austempering process.

26. The method of claim 23, wherein the iron is comprised substantially of ductile iron.

27. The method of claim 23, wherein the primary iron carbides comprise about 40 to about 70 volume percent of the ferritic, pearlitic, or combined ferritic and pearlitic matrix prior to austempering.

28. The method of claim 23, wherein the primary iron carbides comprise about 10 to about 50 volume percent of the ausferritic matrix after austempering.

29. A product produced by:

providing an amount of iron characterized by having either a ferritic, pearlitic, or a combined ferritic and pearlitic matrix with primary iron carbides uniformly dispersed therein; and austempering the iron to produce a substantially ausferritic matrix with the primary iron carbides uniformly dispersed therein.

30. A method of forming a cast iron component, comprising:

providing an amount of iron characterized by having either a ferritic, pearlitic, or a combined ferritic and pearlitic matrix with primary iron carbides uniformly dispersed therein;

providing an amount of primary iron carbide stabilizing agent;

adding the stabilizing agent to the iron; and austempering the iron to produce a substantially ausferritic matrix with the primary iron carbides uniformly dispersed therein, wherein the stabilizing agent is added in a sufficient amount so as to prevent or lessen the dissolution of the primary iron carbides into the ausferritic matrix during the austempering process.

31. The method of claim 30, wherein the stabilizing agent is added prior to the austempering process.

32. The method of claim 30, wherein the iron is comprised substantially of ductile iron.

33. The method of claim 30, wherein the primary iron carbides comprise about 40 to about 70 volume percent of the ferritic, pearlitic, or combined ferritic and pearlitic matrix prior to austempering.

34. The method of claim 30, wherein the primary iron carbides comprise about 10 to about 50 volume percent of the ausferritic matrix after austempering.

35. A product produced by:

providing an amount of iron characterized by having either a ferritic, pearlitic, or a combined ferritic and pearlitic matrix with primary iron carbides uniformly dispersed therein;

providing an amount of primary iron carbide stabilizing agent;

adding the stabilizing agent to the iron; and austempering the iron to produce a substantially ausferritic matrix with the primary iron carbides uniformly dispersed therein, wherein the stabilizing agent is added in a sufficient amount so as to prevent or lessen the dissolution of the primary iron carbides into the ausferritic matrix during the austempering process.

* * * * *